US006805080B2

(12) United States Patent
Golovatai-Schmidt et al.

(10) Patent No.: US 6,805,080 B2
(45) Date of Patent: Oct. 19, 2004

(54) DEVICE FOR CHANGING THE CONTROL TIMES OF GAS EXCHANGE VALVES OF INTERNAL COMBUSTION ENGINE, PARTICULARLY ROTARY PISTON ADJUSTMENT DEVICE FOR ROTATION ANGLE ADJUSTMENT OF A CAMSHAFT RELATIVE TO A CRANKSHAFT

(75) Inventors: Eduard Golovatai-Schmidt, Rottenbach (DE); Jens Schafer, Herzogenaurach (DE); Andreas Strauss, Forchheim (DE); Martin Scheidt, Adelsdorf (DE)

(73) Assignee: INA-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/270,824

(22) Filed: Oct. 15, 2002

(65) Prior Publication Data

US 2003/0084863 A1 May 8, 2003

(30) Foreign Application Priority Data

Oct. 15, 2001 (DE) ..... 101 50 856

(51) Int. Cl.[7] ..... F01L 1/34

(52) U.S. Cl. ..... 123/90.17; 123/90.15; 123/90.31

(58) Field of Search ..... 123/90.17, 90.15, 123/90.31

(56) References Cited

U.S. PATENT DOCUMENTS 6,006,708 A * 12/1999 Ken et al. ..... 123/90.17
6,170,448 B1 * 1/2001 Asakura ..... 123/90.18
6,374,788 B1 * 4/2002 Fukuhara et al. ..... 123/90.17
6,408,807 B1 * 6/2002 Komazawa et al. ..... 123/90.17
6,477,996 B2 * 11/2002 Ogawa ..... 123/90.15
6,516,763 B1 * 2/2003 Strauss ..... 123/90.17

FOREIGN PATENT DOCUMENTS

DE 19929393 10/2001

* cited by examiner

*Primary Examiner*—Thomas Denion
*Assistant Examiner*—Zelalem Eshete
(74) *Attorney, Agent, or Firm*—Volpe and Koenig, P.C.

(57) ABSTRACT

A device for changing the control times of gas exchange valves of an internal combustion engine, including a drive wheel in driving connection with a crankshaft and a vane wheel connected to rotate with a camshaft. A plurality of hydraulic working spaces are formed within the device and are divided by the vanes of the vane wheel into respectively A and B pressure chambers. The vane wheel can be mechanically coupled to the drive wheel by a locking element, which is displaceable by a spring element into a locking position within a seat in one of the sidewalls of the drive wheel, and is hydraulically moved into an unlocked position in the vane wheel upon application of pressure to the pressure chambers. The locking element is a generally uniform cylindrical locking pin, and is arranged in an axial bore in the hub of the vane wheel. The longitudinal axis of the axial bore has a smallest possible distance from the longitudinal mid-axis of the device. The seat has a generally quadrilateral shaped contour that is larger by a play on all sides than the cross sectional area of the locking element, and includes a worm groove opening into it for supplying pressure medium.

8 Claims, 3 Drawing Sheets

DEVICE FOR CHANGING THE CONTROL TIMES OF GAS EXCHANGE VALVES OF INTERNAL COMBUSTION ENGINE, PARTICULARLY ROTARY PISTON ADJUSTMENT DEVICE FOR ROTATION ANGLE ADJUSTMENT OF A CAMSHAFT RELATIVE TO A CRANKSHAFT

BACKGROUND

The invention relates to a device for changing the control times of gas exchange valves of an internal combustion engine, and it can be implemented with particular advantage in a rotary piston adjustment device for rotation angle adjustment of a camshaft relative to a crankshaft.

A representative device of this type is already known from DE 196 23 818 A1. This device is fastened to the drive-side end of a camshaft mounted in the cylinder head of the internal combustion engine, and in principle is formed as a hydraulic actuator which can be controlled based on various operating parameters of the internal combustion engine. This device essentially is formed of a drive wheel drivingly connected with a crankshaft of the internal combustion engine and of a vane wheel connected to rotate with a camshaft of the internal combustion engine. The drive wheel and the vane wheel are drivingly connected each other and transfer torque from the crankshaft to the camshaft of the internal combustion engine. In a preferred embodiment, the drive wheel has a cavity formed by a hollow cylindrical circumferential wall and two sidewalls, in which two hydraulic working spaces are formed by two radial boundary walls extending to the longitudinal mid-axis of the device. The vane wheel correspondingly has, at the circumference of its hub, two vanes extending radially into the working space and dividing the working space into respectively an A pressure chamber and a B pressure chamber which, upon selective or simultaneous application of pressure with a hydraulic pressure medium, effect a pivoting motion or fixation of the vane wheel with respect to the drive wheel and hence of the camshaft with respect to the crankshaft. Furthermore, when the pressure medium pressure falls below that required for adjustment, such as occurs for example on switching off the internal combustion engine, the vane wheel can be mechanically coupled to the drive wheel by a separate locking element in a preferred basic position within its range of adjustment, in order, in particular when the internal combustion engine is restarted, to avoid chatter of the vane wheel on the boundary walls of the drive wheel resulting from the changing moment of the camshaft until the required pressure medium pressure has built up. This locking element, specifically formed as a stepped cylindrical locking pin, is arranged in a bore, parallel to the longitudinal mid-axis of the device, at the end of a vane of the vane wheel, and is displaceable by a spring element into a locking position within a seat in the sidewall of the drive wheel remote from the camshaft. The section of the locking pin that has a greater diameter is guided by the inner wall of the bore in the vane, and the section of the locking pin provided with a smaller diameter, which is also conical on the locking side for exact positioning between the vane wheel and the drive wheel, is guided by a guide bushing inserted into the bore. The seat of the locking pin is specifically formed as an elongate bore drilled into the sidewall of the drive wheel on the side remote from the cam shaft, extending in a direction transverse to the direction of rotation of the vane wheel, and connected by a groove to the A pressure chamber of the device. In addition, the annular surface arising at the transition between the cylindrical sections is also connected to the B chamber of the device via a radial bore, so that the locking pin can be moved hydraulically into an unlocked position within the bore in the vane of the vane wheel both on the application of pressure to the A pressure chambers of the device and also on the application of pressure to the B pressure chambers of the device.

It is however disadvantageous in this known device that the arrangement of the locking pin in a bore at the end of a vane of the vane wheel requires a solid construction of the vane and thus limits the number of possible hydraulic working spaces in the device to a maximum of three to four when the usual adjustment angle of about 30° nominal value is to be realizable with the device. Moreover, the relatively large distance between the longitudinal axis of the bore in the vane of the vane wheel and the longitudinal mid-axis of the device is the origin of a reduction of the rigidity of the locked connection between the vane wheel and drive wheel, and of the still considerable centrifugal forces to which the locking pin is subjected when the engine is running, which in combination with the simultaneously arising dirt sensitivity of the locking device due to the dirt particles in the hydraulic fluid deposited at the end of the vane during rotation can disadvantageously affect the locking function. Likewise, the embodiment of the locking device as a stepped cylindrical locking pin, which is connected by the annular surface arising between the cylindrical sections and by an annular surface on the locking side both to the A pressure chambers and also to the B pressure chambers of the device, is found to be disadvantageous in that locking during shutting off the engine is not possible, since at least one of the two surfaces on the locking pin still has the pressure of the pressure medium acting on it and thus holds the locking pin in its uncoupled position in the bore in the vane of the vane wheel. Thus the device cannot be operated with a specific locking, and above all is unsuitable for application to SOHC engines or to exhaust camshafts, in which a locking of the vane wheel or respectively the camshaft in an "early" control time position of the gas exchange valves of the internal combustion engine is necessary. The conical embodiment of the locking pin on the locking side with a constant cone angle furthermore has the disadvantage, in connection with its elongate seating bore in the drive wheel sidewall remote from the camshaft, that high component loads on the vane wheel and on the drive wheel occur on locking, and that the danger exists on unlocking that jamming of the locking pin in the seating bore occurs. In addition, the increased construction space requirement and the relatively high manufacturing cost for the stepped locking pin are also disadvantageous, since these are the origin of a limited applicability of the device in restricted space conditions in the engine and of the relatively high production costs of the device.

SUMMARY

The invention therefore has as its basic object to provide a device for changing the control times of gas exchange valves of an internal combustion engine, particularly a rotary piston adjusting device for rotation angle adjustment of a camshaft relative to a crankshaft, which device has a locking arrangement between a vane wheel and a drive wheel thereof which is simple and can be produced at a favorable cost, which has a small space requirement. Additionally, the device is, to the greatest possible degree, uninfluenced by centrifugal forces and is also insensitive to dirt, and is arranged or formed such that the locked connection between vane wheel and drive wheel has high rigidity, such that a universal use of the device is possible on SOHC engines or on exhaust camshafts.

This object is attained according to the invention with a device for changing the control times of gas exchange valves of an internal combustion engine including a rotary piston adjustment device for rotation angle adjustment of a camshaft relative to a crankshaft in which the adjustment device is fastened to a drive end of a camshaft mounted in a cylinder head of the internal combustion engine and comprises a hydraulic actuator which is controllable in dependence on at least one operating parameter of the internal combustion engine. The adjustment device includes a drive wheel in driving connection with the crankshaft of the internal combustion engine and a vane wheel connected to rotate with the camshaft of the internal combustion engine. The drive wheel has a cavity formed by a hollow cylindrical circumferential wall and two sidewalls, and at least one hydraulic working space is formed in the cavity by at least two radial boundary walls. The vane wheel has at least one vane that extends radially into a working space of the drive wheel located at a circumference of a hub of the vane wheel which divides the working space into respectively an A pressure chamber and a B pressure chamber. The pressure chambers effect a pivoting motion or a fixation of the vane wheel with respect to the drive wheel upon selective or simultaneous application of a hydraulic pressure medium and thereby effect a pivoting motion or fixation of the camshaft relative to the crankshaft. The vane wheel is mechanically couplable to the drive wheel in a preferred base position within an adjustment range by a separate locking element upon the pressure medium pressure being lower than a predetermined level required for adjustment. The locking element is arranged in a bore, parallel to the longitudinal mid-axis of the device, in the vane wheel and is displaceable by a spring element into a locking position within a seat in one of the sidewalls of the drive wheel. The seat of the locking element is connected to at least one of the pressure chambers within the device, so that upon application of pressure to the at least one of the pressure chambers, the locking element is hydraulically moveable into an unlocked position within the bore in the vane wheel. The locking element is formed as a cylindrical locking pin that is uniform over its whole length and is arranged in an axial bore in the hub of the vane wheel. The longitudinal axis of the bore is at as small as possible a distance from the longitudinal mid-axis of the device.

In an advantageous development of the device according to the invention, the locking pin seat arranged in one of the sidewalls of the drive wheel has a generally quadrilateral shaped contour and has an area that is larger by a defined play on all sides than the cross sectional area of the locking pin. A worm groove opening is provided into it for supplying pressure medium, and in the locking position of the vane wheel, it is connected to an A pressure chamber of the device which is devoid of pressure. Accordingly, the seat of the locking pin can be acted on by a pressurized hydraulic medium sufficient to unlock the locking pin only when the pressure chambers of the device are subjected to pressure.

As an advantageous embodiment of the device according to the invention, it is furthermore proposed that the locking pin is formed at its end facing the seat with a chamfer and a rounding of its end margin and also with a hollow end, while at its rear end it has a base bore for fixing one end of a spring element, which is preferably in the form of a compression coil spring. The other end of the spring element is then supported on a counter-holder inserted in the axial bore for the locking pin and including a centering tip. The counter-holder preferably has a Y-shaped profile in cross section in which the longitudinal grooves are provided between its profile edges for pressure medium air venting of the axial bore.

The construction of the end of the locking pin on the seat side with the defined contour as described here serves to ensure that the torque loading of the locking pin occurring from a given point during the unlocking process does not cause the locking pin to jam, or respectively makes possible a reliable and accelerated unlocking of the locking pin. At this point, shortly after the beginning of pressure application to the A pressure chambers of the device and to the seat of the locking pin corresponding to this, the locking pin has a position, not yet completely displaced into its unlocking position, in which due to the constantly rising pressure of the hydraulic pressure medium, a relative motion between the vane wheel and the drive wheel of the device sets in, conditioned by play, and the edge of the seat at the outer surface of the locking pin exerts a shearing force or a torque on the locking pin. Since, however, the end of the locking pin toward the seat at this point has the mentioned chamfer and the adjoining rounding of the end margin, on the one hand, jamming of the locking pin is thereby avoided, and on the other hand, an additional catapult effect associated with rolling-off is produced, with which the effective torque is converted into an axial force and is used for the acceleration of the axial motion of the locking pin into its unlocking position.

The hollow structure of the locking pin end toward the seat has on the other hand been found to be advantageous for the reduction of the adhesion forces between the surface of this end side and the stop face in the seat of the locking pin, and contributes to a shortening of the unlocking time in that only the adhesion forces between the annular surface arising at the end of the locking pin and the stop face in the seat still have to be overcome.

In regard to the base bore arranged in the rear end of the locking pin and in which the one end of the spring element provided as a compression coil spring is fixed, there exists alternatively the possibility of permitting this to be completely omitted if the compression coil spring used is not smaller in diameter, as provided, than the locking pin but has about the same diameter, or when instead of the compression coil spring, for example a conical spring having on one side the diameter of the locking pin is used. Likewise, it is possible to support the other end of the spring element, instead of on the centering pin of the described counter-holder, on a counter-holder formed as an inserted bushing or in another suitable fashion, which has a central and/or plural concentric bore(s) for pressure medium air venting of the axial bore, or else to form the axial bore as a stepped bore, in which the arising shoulder of the bore is used to support the other end of the spring element, and the pressure medium air venting takes place through the reduced diameter portion of the axial bore. The pressure medium air venting here always takes place against the existing atmospheric pressure in an advantageous manner independently of its design, and can be carried out in the same way both on chain-driven and on belt-driven devices. The air-vented pressure medium is conducted away, in the case of a chain drive, directly into the cylinder head, and in the case of a belt drive, into a tank duct in the camshaft via an additional flange seal on the sidewall of the device facing toward the camshaft.

As a further advantageous embodiment of the device according to the invention, the seat for the locking pin is incorporated in the drive wheel sidewall remote from the camshaft and has a generally quadrilateral shaped contour that is arranged below the radial end of one of the boundary walls of the drive wheel in the mounted device, and the worm groove, which extends with a quarter-circle-shaped course as far as the height of the stop face of an adjacent boundary wall of the drive wheel, opens into the contour from a rotation direction side of the vane wheel. The side of the contour of the seat opposite to the side into which the worm groove opens is here additionally formed with a hardened inlet radius to facilitate the latching of the locking pin into the seat, while the corners of the contour are rounded off with a radius complementary to the diameter of the locking pin. The base of the seat furthermore has two planes of different depths, of which the upper plane is provided as a stop face for the end of the locking pin toward the seat. The lower plane of the seat base, which incorporated into the upper plane of the seat base, has on the other hand a transition to the opening worm groove and is provided for supplying the hydraulic pressure medium to the end of the locking pin. The opening of the worm groove preferably has a square or nearly square cross section and is incorporated with a smaller depth than the seat into the sidewall of the drive wheel. Other suitable cross sections for the worm groove and/or a depth of the worm groove merging similarly or uniformly into the lower plane of the seat are also possible.

The shape of the seat, formed as mentioned at the beginning having a larger area by a defined play than the cross sectional area of the locking pin, furthermore serves on the one hand for the equalization of the radial bearing play between the vane wheel, mounted on the radial ends of the boundary walls of the drive wheel, and the drive wheel, and also on the other hand for the equalization of position tolerances related to manufacturing between the locking pin in the wheel hub of the vane wheel and its seat in the sidewall of the drive wheel, both in the radial and in the circumferential direction of the device. The enlarged formation of the seat also makes it possible to set an optimum play for the locking pin when assembling the device, in order to avoid jamming of the locking pin in the seat. The sealing of the enlarged seat and of the worm groove opening into it against internal pressure medium leakages here takes place by the side face of the hub of the vane wheel remote from the camshaft, which surface abuts on the inner surface of the sidewall, remote from the camshaft, of the drive wheel in the assembled device.

The device according to the invention for changing the control times of gas exchange valves of an internal combustion engine, particularly a rotary piston adjusting device for rotation angle adjustment of a camshaft relative to a crankshaft, thus has the advantage over the devices known from the state of the art that due to the relocation of the locking from a vane of the vane wheel into the hub of the vane wheel, or respectively by the considerable shortening of the distance between the longitudinal axis of the locking device and the longitudinal mid-axis of the device, on the one hand the rigidity of the locked connection between the vane wheel and the drive wheel is substantially increased, and on the other hand the centrifugal forces acting on the locking pin when the engine is running are considerably reduced. Since the locking is thus also no longer arranged in the region of the pressure chambers of the device and also outside the pressure medium ducts to the pressure chambers, functional disturbances of the locking due both to centrifugal force and also due to dirt particles deposited in the hydraulic pressure medium are nearly eliminated. Likewise, it is thereby possible to form the vanes of the vane wheel less solidly, for example in plate form, and thus to reduce the production costs of the device and also to increase the number of possible working spaces in the device.

The device according to the invention furthermore has the advantage that the locking pin, formed as a uniform cylinder over its whole length, can be produced easily and cost-favorably, and also has a small construction space requirement, so that the production costs of the device are still further reduced and the device can also be used universally, even when the space conditions in the engine compartment are restricted. The special design of the seat for the locking pin and of the end of the locking pin in working connection with the seat is a causal factor here for component loadings no longer occurring during locking between the vane wheel and the drive wheel of the device, and jamming of the locking pin in the seat during unlocking is no longer possible.

Furthermore, the connection of the seat for the locking pin exclusively with one of the A pressure chambers of the device has the particular advantage that a specific locking of the device on turning off the internal combustion engine is possible. Since on turning off the engine, and hence with no current supply to the control valve of the device, the pressure medium pressure is applied to the B pressure chambers, the vane wheel, for the most part with volume minimization of the respective A pressure chambers of the device, is rotated into the base position required for the starting of the internal combustion engine, in which position the locking pin is then reliably locked in. By keeping to such a switching logic for the control valve, that is, always to switch the pressure medium pressure, when the internal combustion engine is turned off, to the pressure chambers of the device which rotate the vane wheel again into the desired base position, the device according to the invention can thus be used both on inlet camshafts with locking in "late" control time position of the gas exchange valves and also with exhaust camshafts and on SOHC engines with locking in "early" control time position of the gas exchange valves.

When using the device according to the invention on exhaust camshafts or on SOHC engines, it has furthermore been found to be advantageous to equalize the drag moment acting in the "late" direction, and thus in the direction away from the base position, by an additional spring element which equalizes the adjustment time of the device, engages on the drive wheel and on the vane wheel, and produces a preload moment between these. In the device according to the invention, this can with particular advantage be implemented by a flat strip coil spring arranged outside in front of the sidewall of the drive wheel remote from the camshaft, with its outer suspension point formed by an elongated fastening screw for the sidewalls, and with its inner suspension point connected with the central screw of the device.

BRIEF DESCRIPTION OF THE DRAWINGS

The invention is explained in detail hereinafter on the basis of a preferred embodiment, and is schematically shown in the accompanying drawings.

DETAILED DESCRIPTION OF THE PREFERRED EMBODIMENT

Figure 1:
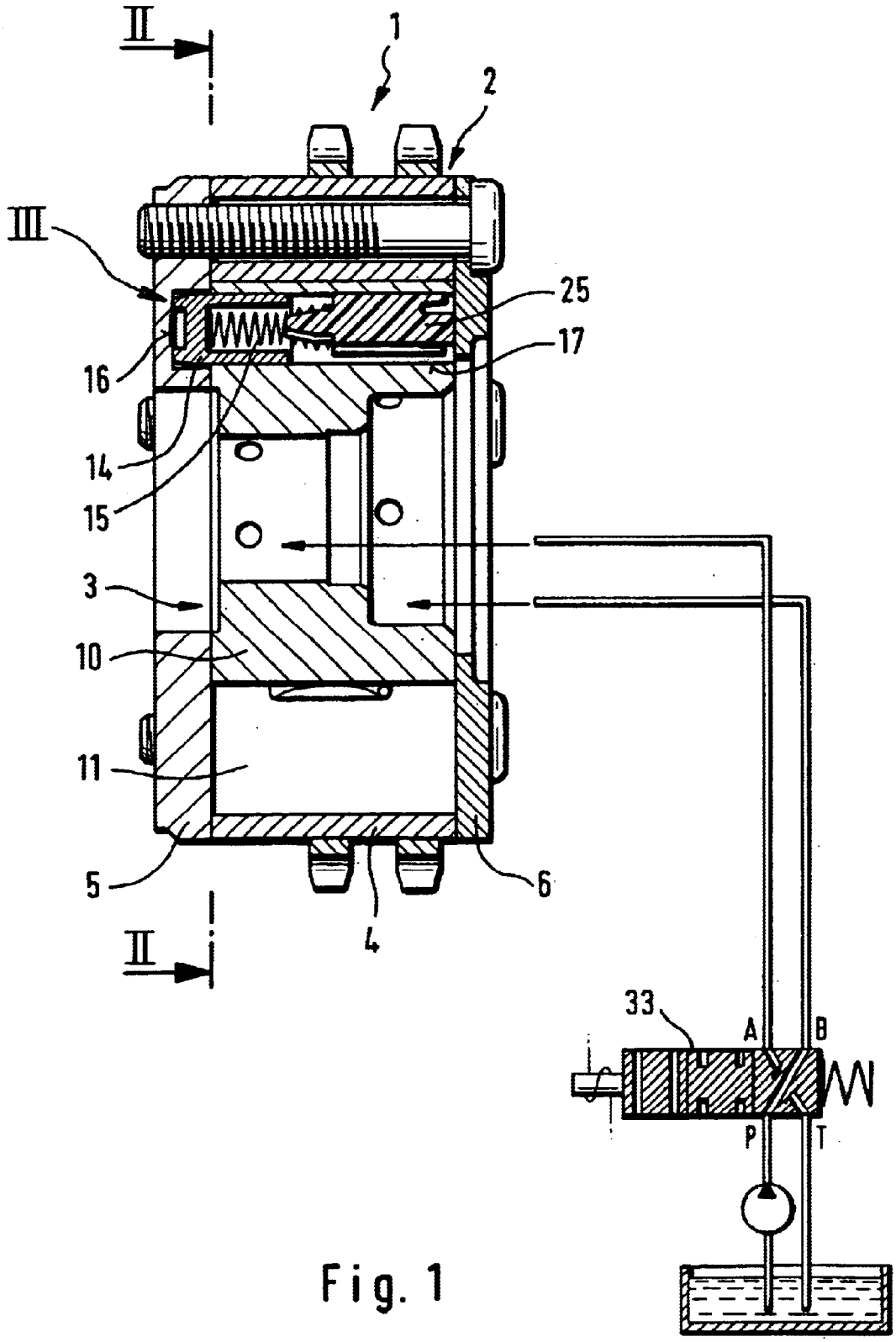
FIG. 1 is a longitudinal section taken along the line B—B of FIG. 2 through a device according to the invention.
Figure 2:
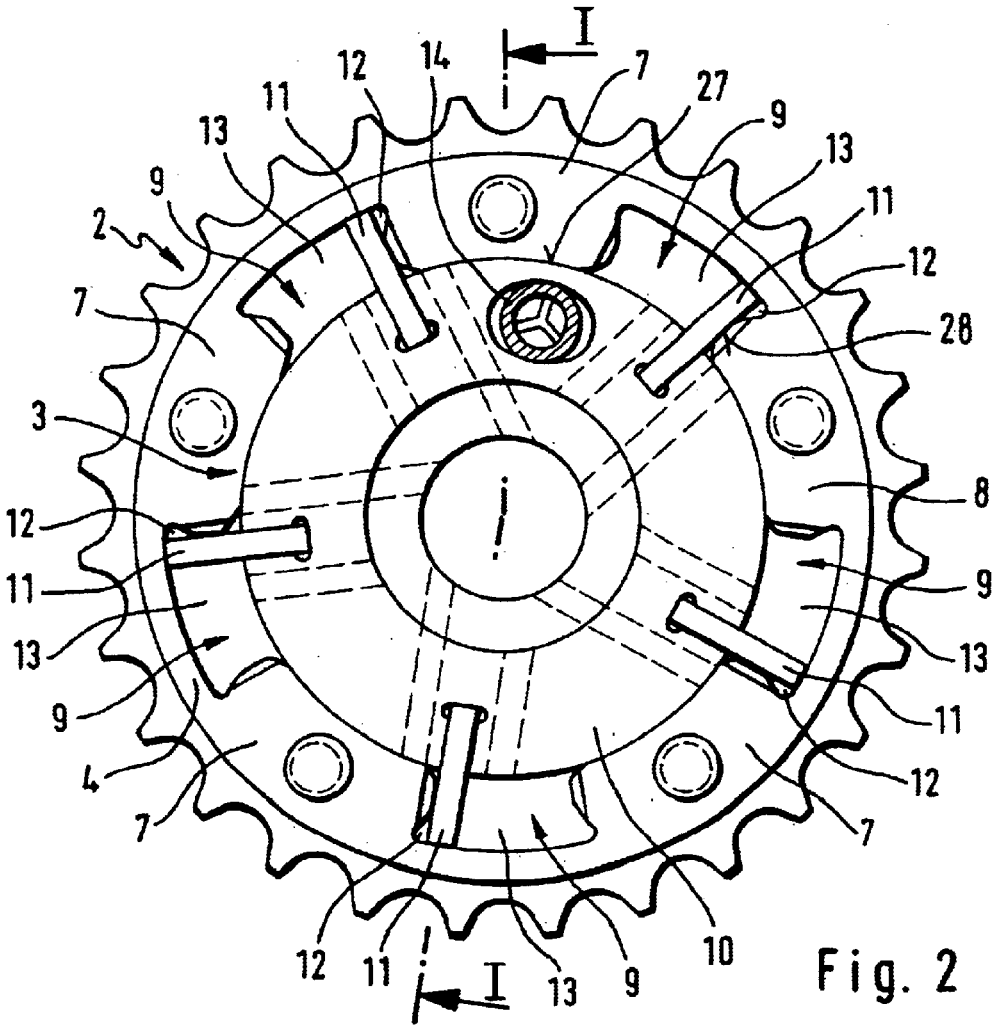
FIG. 2 is a cross section taken along the line A—A according to FIG. 1 through a device according to the invention.

A device 1 for changing the control times of gas exchange valves of an internal combustion engine can be clearly seen in FIGS. 1 and 2, and is formed as a rotary piston displacement device for rotation angle adjustment of a camshaft (not shown) relative to a crankshaft (likewise not shown) of an internal combustion engine. The device 1 is fastened to the drive-side end of a camshaft mounted in the cylinder head of the internal combustion engine, and is in principle formed as a hydraulic actuator which is controlled based on various operating parameters of the internal combustion engine by means of the hydraulic valve referenced 33 in FIG. 1.

Furthermore, it can be seen in FIGS. 1 and 2 that the device 1 essentially includes a drive wheel 2 drivingly connected with the crankshaft of the internal combustion engine and a vane wheel 3 connected to rotate with the camshaft of the internal combustion engine. The vane wheel 3 is pivotably mounted in the drive wheel 2 and in driving connection therewith. The drive wheel 2 has a cavity formed by a hollow cylindrical circumferential wall 4 and two sidewalls 5, 6 and in which five equally circumferentially distributed hydraulic working spaces 9 are formed by five radial boundary walls 7 and 8 that extend toward the longitudinal mid-axis of the device 1. The vane wheel 3 of the device 1 correspondingly has five equally circumferentially distributed vanes 11 at its hub 10, respectively extending radially into the working spaces 9 of the drive wheel 2, and dividing the working spaces 9 into respectively an A pressure chamber 12 and a B pressure chamber 13, which upon selective or simultaneous application of pressure with a hydraulic pressure medium effect a pivoting motion or fixation of the vane wheel 3 with respect to the drive wheel 2 and therewith a rotation angle adjustment or hydraulic clamping of the camshaft relative to the crankshaft.

Furthermore it can be seen, particularly from FIG. 1, that the device 1 has a separate locking element 14 in order to prevent chatter of the vane wheel 3 against the stops resulting from the changing moments of the camshaft when starting the internal combustion engine. This allows the vane wheel 3, to be mechanically coupled in a preferred base position within its adjustment range to the drive wheel 2 when the pressure medium pressure is lower than that required for adjustment. This locking element 14 is arranged in a bore, parallel to the longitudinal mid-axis of the device 1, in the vane wheel 3, and is displaceable by means of a spring element 15 into a locking position within a seat 16 in the sidewall 5 of the drive wheel 2. By a connection of the seat 16 of the locking element 14 with at least one pressure chamber 12 or 13 within the device 1 it is possible to move the locking element 14 hydraulically on application of pressure to the pressure chambers 12, 13 back into its unlocked position within the bore in the vane wheel 3.

Figure 3:
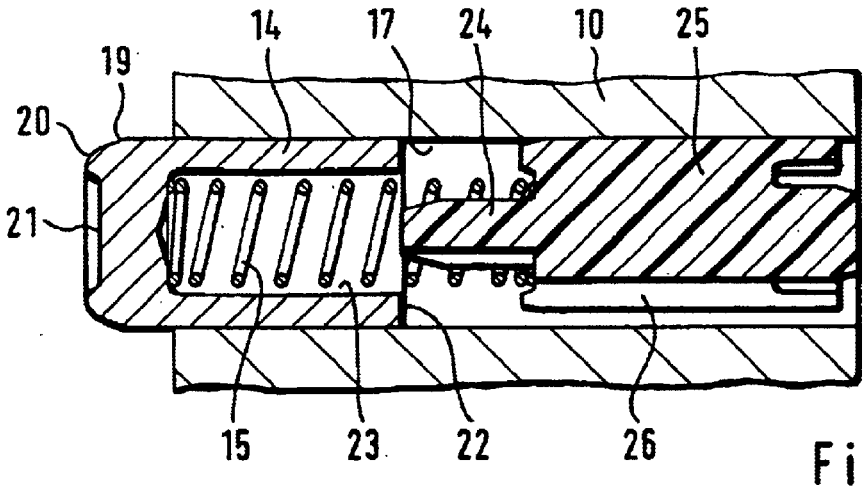
FIG. 3 is an enlarged view of a portion indicated at X according to FIG. 1 and the locking pin of the device according to the invention.

Particularly from FIGS. 1–3, it can furthermore be gathered in this respect that the locking element 14 according to the invention is formed as a cylindrical locking pin this is uniform over its whole length and is arranged in a through axial bore 17 in the hub 10 of the vane wheel 3. It can be clearly seen in FIG. 2 that the longitudinal axis of this axial bore 17 has as small as possible a distance from the longitudinal mid-axis of the device 1, in order to minimize the centrifugal force effects on the locking element 14 arising when the engine is running. Furthermore the locking element 14, as can be seen in FIG. 3, is provided on the seat side with a chamfer 19 and a rounding 20 of its end margin, which serve to accelerate the axial motion of the locking element 14 into its unlocking position and thus to avoid jamming of the locking element. A "sticking" of the locking element 14 in the seat 16 occasioned by adhesion forces is thereby additionally avoided by a hollow end construction, which can also be seen in FIG. 3, locate on the front side 21 of the locking element 14. At its rear end 22, on the other hand, the locking element 14 has a base bore 23 in which one end of the spring element 15, provided as a compression coil spring, is fixed, as can likewise be seen from FIG. 3. The other end of this spring element 15 is supported on a counter-holder 25 having a centering tip 24 and inserted into the axial bore 17 and having a Y-shaped profile cross section in which the longitudinal grooves 26 are formed between profile edges that allow for pressure medium air venting of the axial bore 17.

Figure 4:
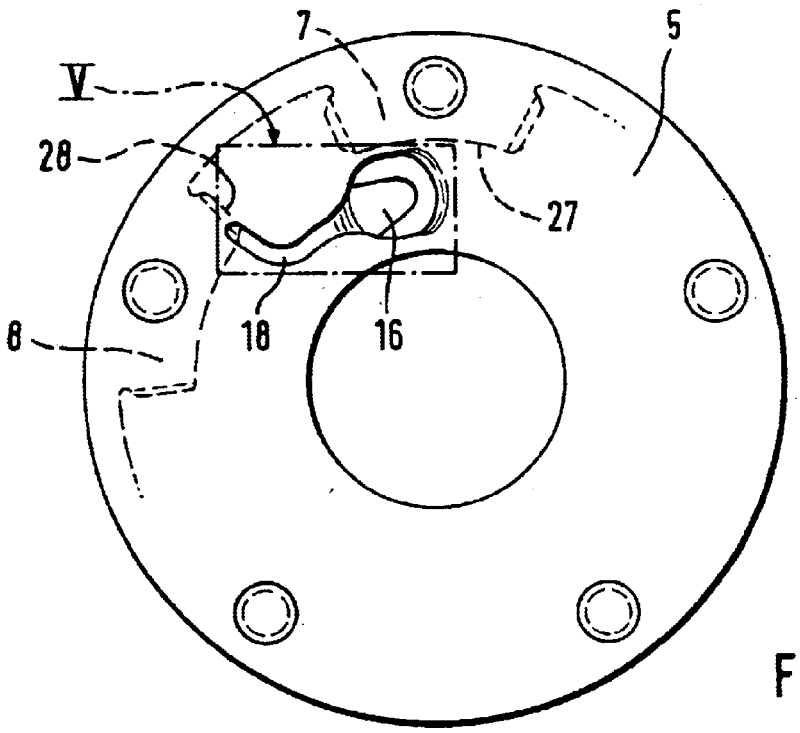
FIG. 4 is a top view of the inside of the sidewall, remote from the camshaft, of the drive wheel of the device according to the invention.

The seat 16 of the locking element 14, which can be seen in FIG. 4, furthermore has, according to the invention, a shape formed with a generally quadrilateral contour and is larger by a defined play on all sides than the cross sectional area of the locking element 14. A worm groove 18 connected exclusively with an A pressure chamber opens into the seat 16, and is devoid of pressure in the locking position of the device 1. It is thereby ensured that the seat 16 of the locking element 14 has the pressure of the hydraulic pressure medium applied to it, via the worm groove 18, thus moving the locking element 14 into its unlocked position, only upon the application of pressure to the A pressure chambers 12 of the device 1.

Figure 5:
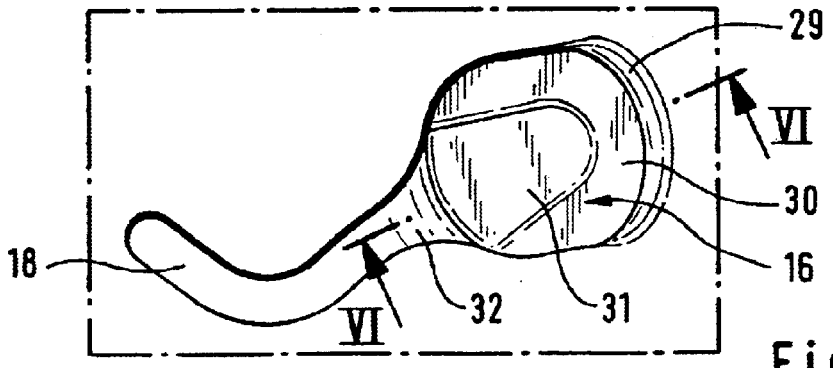
FIG. 5 is an enlarged view of the portion indicated at Z in FIG. 4 of the seat of the locking pin of the device according to the invention.
Figure 6:
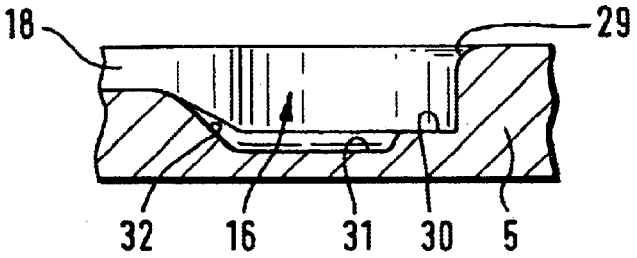
FIG. 6 is a cross section taken along line C—C according to FIG. 5 through the seat of the locking pin of the device according to the invention.

It can furthermore be seen from FIG. 4 that the seat 16 of the locking element 14 is incorporated into the sidewall 5, remote from the camshaft, of the drive wheel 2, and has a quadrilateral contour which is arranged, when the device 1 is mounted, beneath the radial end side 27, shown dashed lines in the Figure, of a boundary wall 7 of the drive wheel 2. Here the worm groove 18 has a quarter-circle-shaped course up to the height of the stop surface 28, likewise shown in dashed lines, of an adjacent boundary wall 8, and opens from a side situated in the direction of rotation of the vane wheel 3 into the contour of the seat 16. The side contour of the seat 16 opposite to the side with the worm groove 18, on the other hand, is formed, as shown by the enlargements of FIGS. 5 and 6, with a hardened inlet radius 29 which facilitates the latching of the locking element 14 in the seat 16. It is likewise shown in FIGS. 5 and 6 that the corners, not shown in detail, of the seat contour are rounded with a radius corresponding to the diameter of the locking pin 14, and that the base of the seat 16 has two planes 30, 31 of different depths. The upper plane 30 provides a stop surface for the locking pin 14 in the seat 16, while the lower plane 31 incorporated into the upper plane 30 has a transition 32 to the worm groove 18 which opens in, and is provided for supplying the hydraulic pressure medium to the end 21 of the locking element 14.

| REFERENCE NUMERALS | |
|---|---|
| 1 | device |
| 2 | drive wheel |
| 3 | vane wheel |
| 4 | circumferential wall |
| 5 | sidewall |
| 6 | sidewall |
| 7 | boundary wall |
| 8 | boundary wall |
| 9 | working space |
| 10 | hub |
| 11 | vane |
| 12 | A pressure chamber |
| 13 | B pressure chamber |
| 14 | locking element |
| 15 | spring element |
| 16 | seat |
| 17 | axial bore |
| 18 | worm groove |
| 19 | chamfer |
| 20 | rounding |
| 21 | hollow end |
| 22 | rear end |
| 23 | base bore |
| 24 | centering tip |
| 25 | counter-holder |
| 26 | longitudinal grooves |
| 27 | radial end |
| 28 | stop surface |
| 29 | inlet radius |
| 30 | upper plane |
| 31 | lower plane |

-continued

| REFERENCE NUMERALS |
| --- |
| 32 transition |
| 33 hydraulic valve |

What is claimed is:

1. Device for changing the control times of gas exchange valves of an internal combustion engine including a rotary piston adjustment device for rotation angle adjustment of a camshaft relative to a crankshaft, comprising:

the adjustment device is fastened to a drive end of a camshaft mounted in a cylinder head of the internal combustion engine and comprises a hydraulic actuator which is controllable in dependence on at least one operating parameter of the internal combustion engine, the adjustment device includes a drive wheel in driving connection with the crankshaft of the internal combustion engine and a vane wheel connected to rotate with the camshaft of the internal combustion engine, the drive wheel has a cavity formed by a hollow cylindrical circumferential wall and two sidewalls, and at least one hydraulic working space is formed in the cavity by at least two radial boundary walls, the vane wheel has at least one vane that extends radially into the working space of the drive wheel located at a circumference of a hub of the vane wheel, the vane divides the working space into respectively an A pressure chamber and a B pressure chamber, the pressure chambers effect a pivoting motion or a fixation of the vane wheel with respect to the drive wheel upon selective or simultaneous application of a hydraulic pressure medium and thereby effect a pivoting motion or fixation of the camshaft relative to the crankshaft, the vane wheel being mechanically couplable to the drive wheel in a preferred base position within an adjustment range by a separate locking element upon the pressure medium pressure being lower than a predetermined level required for adjustment, the locking element is arranged in a bore, parallel to the longitudinal mid-axis of the device, in the vane wheel and is displaceable by a spring element into a locking position within a seat in one of the sidewalls of the drive wheel, the seat of the locking element has a generally quadrilateral shaped contour which has a larger area as defined by a play on all sides than a cross sectional area of the locking element and is connected to at least one of the pressure chambers within the device, so that upon application of pressure to the at least one of the pressure chambers, the locking element is hydraulically movable into an unlocked position within the bore in the vane wheel, wherein the locking element is comprised of a cylindrical locking pin that is generally uniform over an entire length thereof and is arranged in an axial bore in the hub of the vane wheel, a longitudinal axis of the axial bore having as small as possible a distance from the longitudinal mid-axis of the device.

2. Device according to claim 1, wherein the seat of the locking element in one of the sidewalls of the drive wheel includes a worm groove opening into it for supplying pressure medium, and the worm groove is exclusively connected to the A pressure chamber of the device, which is devoid of pressure in the locking position of the vane wheel, and through which the pressure of the hydraulic pressure medium is applied to the seat of the locking element only upon pressure being applied to the A pressure chamber.

3. Device according to claim 1, wherein the locking element includes a seat engaging end with a chamfer and a rounding at an end margin thereof and also is provided with a hollow portion at the end, and includes a rear end having a base bore for fixing one end of the spring element, which comprises a compression coil spring, another end of the spring element is supported on a counter-holder inserted into the axial bore which includes a centering tip, the counter-holder has a Y-shaped profile in cross-section in which the longitudinal grooves are formed between profile edges which provide for pressure medium air venting of the axial bore.

4. Device according to claim 1, wherein the seat of the locking element includes a worm groove opening therein for supplying the hydraulic pressure medium and is incorporated into the sidewall, remote from the camshaft, of the drive wheel, and is positioned such that a quadrilateral shaped contour thereof is arranged beneath a radial end of one of the boundary walls of the drive wheel when the device is mounted, and the worm groove has a quarter-circle-shaped course that extends up to a height of a stop surface of an adjacent boundary wall of the drive wheel, and is arranged to open on a side situated in a direction of rotation of the vane wheel into the contour of the seat.

5. Device according to claim 4, wherein a side of the contour of the seat opposite the side with the worm groove includes a surface-hardened inlet radius, and the corners of the contour are rounded with a radius matched to the locking element, a base of the seat has upper and lower planes located at different depths, the upper plane acts as a stop surface for the locking element, and the lower plane has a transition to the opening of the worm groove and is provided for supplying the hydraulic pressure medium to an end of the locking element.

6. Device for changing the control times of gas exchange valves of an internal combustion engine including a rotary piston adjustment device for rotation angle adjustment of a camshaft relative to a crankshaft, comprising:

the adjustment device is fastened to a drive end of a camshaft mounted in a cylinder head of the internal combustion engine and comprises a hydraulic actuator which is controllable in dependence on at least one operating parameter of the internal combustion engine, the adjustment device includes a drive wheel in driving connection with the crankshaft of the internal combustion engine and a vane wheel connected to rotate with the camshaft of the internal combustion engine, the drive wheel has a cavity formed by a hollow cylindrical circumferential wall and two sidewalls, and at least one hydraulic working space is formed in the cavity by at least two radial boundary walls, the vane wheel has at least one vane that extends radially into the working space of the drive wheel located at a circumference of a hub of the vane wheel, the vane divides the working space into respectively an A pressure chamber and a B pressure chamber, the pressure chambers effect a pivoting motion or a fixation of the vane wheel with respect to the drive wheel upon selective or simultaneous application of a hydraulic pressure medium and thereby effect a pivoting motion or fixation of the camshaft relative to the crankshaft, the vane wheel being mechanically couplable to the drive wheel in a preferred base position within an adjustment range by a separate locking element upon the pressure medium pressure being lower than a predetermined level required for adjustment, the locking element is arranged in a bore, parallel to the longitudinal mid-axis of the device, in the vane wheel and is displaceable by a spring element into a locking position within a seat in one of the sidewalls of the drive wheel, the seat of the locking element is connected to at least one of the pressure chambers within the device, so that upon application of pressure to the at least one of the pressure chambers, the locking element is hydraulically movable into an unlocked position within the bore in the vane wheel, wherein the locking element is comprised of a cylindrical locking pin that is generally uniform over an entire length thereof and is arranged in an axial bore in the hub of the vane wheel, a longitudinal axis of the axial bore having as small as possible a distance from the longitudinal mid-axis of the device, and includes a seat engaging end with a chamfer and a rounding at an end margin thereof and also is provided with a hollow portion at the end, and includes a rear end having a base bore for fixing one end of the spring element, which comprises a compression coil spring, and another end of the spring element is supported on a counter-holder inserted into the axial bore which includes a centering tip, the counter-holder has a Y-shaped profile in cross-section in which the longitudinal grooves are formed between profile edges which provide for pressure medium air venting of the axial bore.

7. Device for changing the control times of gas exchange valves of an internal combustion engine including a rotary piston adjustment device for rotation angle adjustment of a camshaft relative to a crankshaft, comprising:

the adjustment device is fastened to a drive end of a camshaft mounted in a cylinder head of the internal combustion engine and comprises a hydraulic actuator which is controllable in dependence on at least one operating parameter of the internal combustion engine, the adjustment device includes a drive wheel in driving connection with the crankshaft of the internal combustion engine and a vane wheel connected to rotate with the camshaft of the internal combustion engine, the drive wheel has a cavity formed by a hollow cylindrical circumferential wall and two sidewalls, and at least one hydraulic working space is formed in the cavity by at least two radial boundary walls, the vane wheel has at least one vane that extends radially into the working space of the drive wheel located at a circumference of a hub of the vane wheel, the vane divides the working space into respectively an A pressure chamber and a B pressure chamber, the pressure chambers effect a pivoting motion or a fixation of the vane wheel with respect to the drive wheel upon selective or simultaneous application of a hydraulic pressure medium and thereby effect a pivoting motion or fixation of the camshaft relative to the crankshaft, the vane wheel being mechanically couplable to the drive wheel in a preferred base position within an adjustment range by a separate locking element upon the pressure medium pressure being lower than a predetermined level required for adjustment, the locking element is arranged in a bore, parallel to the longitudinal mid-axis of the device, in the vane wheel and is displaceable by a spring element into a locking position within a seat in one of the sidewalls of the drive wheel, the seat of the locking element includes a worm groove opening into it for supplying the hydraulic pressure medium and is connected to at least one of the pressure chambers within the device, so that upon application of pressure to the at least one of the pressure chambers, the locking element is hydraulically movable into an unlocked position within the bore in the vane wheel, wherein the locking element is comprised of a cylindrical locking pin that is generally uniform over an entire length thereof and is arranged in an axial bore in the hub of the vane wheel, a longitudinal axis of the axial bore having as small as possible a distance from the longitudinal mid-axis of the device, the seat of the locking element is incorporated into the sidewall, remote from the camshaft, of the drive wheel, and is positioned such that a quadrilateral shaped contour thereof is arranged beneath a radial end of one of the boundary walls of the drive wheel when the device is mounted, and the worm groove has a quarter-circle-shaped course that extends up to a height of a stop surface of an adjacent boundary wall of the drive wheel, and is arranged to open on a side situated in a direction of rotation of the vane wheel into the contour of the seat.

8. Device according to claim 7, wherein a side of the contour of the seat opposite the side with the worm groove includes a surface-hardened inlet radius, and the corners of the contour are rounded with a radius matched to the locking element, a base of the seat has upper and lower planes located at different depths, the upper plane acts as a stop surface for the locking element, and the lower plane has a transition to the opening of the worm groove and is provided for supplying the hydraulic pressure medium to an end of the locking element.

* * * * *